US005923348A

United States Patent [19]

Cunnagin et al.

[11] Patent Number: 5,923,348

[45] Date of Patent: Jul. 13, 1999

[54] METHOD OF PRINTING USING A PRINTHEAD HAVING MULTIPLE ROWS OF INK EMITTING ORIFICES

[75] Inventors: Stephen Kelly Cunnagin; Scott Michael Heydinger, both of Lexington, Ky.

[73] Assignee: Lexmark International, Inc., Lexington, Ky.

[21] Appl. No.: 08/806,172

[22] Filed: Feb. 26, 1997

[51] Int. Cl.[6] ..... B41J 2/155; B41J 2/01

[52] U.S. Cl. ..... 347/42; 347/101

[58] Field of Search ..... 347/42, 12, 40, 347/43, 15, 102, 101

[56] References Cited

U.S. PATENT DOCUMENTS

| | | | |
|---|---|---|---|
| 4,344,079 | 8/1982 | Chambors et al. | 347/12 |
| 4,395,720 | 7/1983 | Grover et al. | 347/12 |
| 4,528,575 | 7/1985 | Matsuda et al. | 347/71 |
| 4,540,996 | 9/1985 | Saito | 347/43 |
| 4,612,554 | 9/1986 | Poleshuk | 347/63 |
| 4,622,560 | 11/1986 | Withoos et al. | 347/12 |
| 4,675,692 | 6/1987 | Goshima et al. | 347/12 |
| 4,680,596 | 7/1987 | Logan | 347/15 |
| 4,922,271 | 5/1990 | Nilsson et al. | 347/39 |
| 4,940,996 | 7/1990 | Paton et al. | 347/42 |
| 4,965,593 | 10/1990 | Hickman | 347/12 |
| 4,972,270 | 11/1990 | Kurtin et al. | 358/296 |
| 5,109,239 | 4/1992 | Cobbs et al. | 347/19 |
| 5,142,296 | 8/1992 | Lopez et al. | 347/12 |
| 5,239,312 | 8/1993 | Merna et al. | 347/43 |
| 5,322,594 | 6/1994 | Bol | 216/27 |
| 5,365,645 | 11/1994 | Walker et al. | 29/25.35 |
| 5,469,199 | 11/1995 | Allen et al. | 347/42 |

*Primary Examiner*—N. Le
*Assistant Examiner*—Thinh Nguyen
*Attorney, Agent, or Firm*—John J. McArdle

[57] ABSTRACT

The invention is directed to a method of manufacturing a printhead in an ink jet printer for jetting an ink onto a print medium. An advance speed of the print medium in a feed direction in the ink jet printer is determined. An approximate drying time of the ink after being jetted onto the print medium from the printhead is also determined. At least two rows of ink emitting orifices are formed in the printhead, with each row of orifices extending substantially across a width of the print medium. Each row of orifices is spaced apart from an adjacent row of orifices in the feed direction a distance which is dependent upon the advance speed of the print medium and the drying time of the ink.

8 Claims, 2 Drawing Sheets

METHOD OF PRINTING USING A PRINTHEAD HAVING MULTIPLE ROWS OF INK EMITTING ORIFICES

BACKGROUND OF THE INVENTION

1. Field of the Invention

The present invention relates to ink jet printers, and, more particularly, to a method of manufacturing a printhead in an ink jet printer and a method of printing using a subset of the ink emitting orifices in the printhead.

2. Description of the Related Art

An ink jet printer typically includes a printhead having an array of ink emitting orifices formed therein. The printhead is mounted on a carriage assembly which scans a width of the print medium. During a scan of the carriage assembly, ink is jetted from selected ones of the ink emitting orifices to produce a desired print image on the print medium.

It is also known to provide an ink jet printer with a printhead which extends substantially across the width of the print medium. For an ink jet printer with a 300 dot per inch (dpi) resolution, a single row of ink emitting orifices in such a printhead would include at least 2400 ink emitting orifices (i.e., 300 orifices/inch*8 inches/page width=2400 orifices/page width).

With a page wide printhead as described above, a print quality problem may arise with respect to the associated physical geometry of the printhead due to the spatial locality of the ink emitting orifices. Because the orifices are located in a substantially linear array extending across the width of the print medium, ink dots from adjacent orifices which are to be placed within a given raster are placed on the print medium at approximately the same time. If the printhead includes multiple rows of orifices extending across the width of the page, adjacent ink dots in a given row and adjacent ink dots between rows are placed on the print medium in close proximity to each other with respect to time. For various print media, particularly transparencies, poor print quality results when ink dots are placed at adjacent positions on the print medium at approximately the same time.

SUMMARY OF THE INVENTION

The present invention provides a method of manufacturing a page-width printhead for use in an ink jet printer, with the printhead including at least two rows of ink emitting orifices which are spaced apart in the paper feed direction a distance which is dependent upon an advance speed of the paper and a drying time of the ink after being jetted onto the paper.

The invention comprises, in one form thereof, a method of manufacturing a printhead in an ink jet printer for jetting an ink onto a print medium. An advance speed of the print medium in a feed direction in the ink jet printer is determined. An approximate drying time of the ink after being jetted onto the print medium from the printhead is also determined. At least two rows of ink emitting orifices are formed in the printhead, with each row of orifices extending substantially across a width of the print medium. Each row of orifices is spaced apart from an adjacent row of orifices in the feed direction a distance which is dependent upon the advance speed of the print medium and the drying time of the ink.

An advantage of the present invention is that a printhead for an ink jet printer is provided which has at least two page-wide rows of ink emitting orifices which are spaced apart in the feed direction a distance which allows the ink jetted from one of the rows of orifices to substantially dry before ink is jetted from an adjacent row of orifices.

Other features and advantages of the invention may be realized from the drawings and detailed description of the invention that follows.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
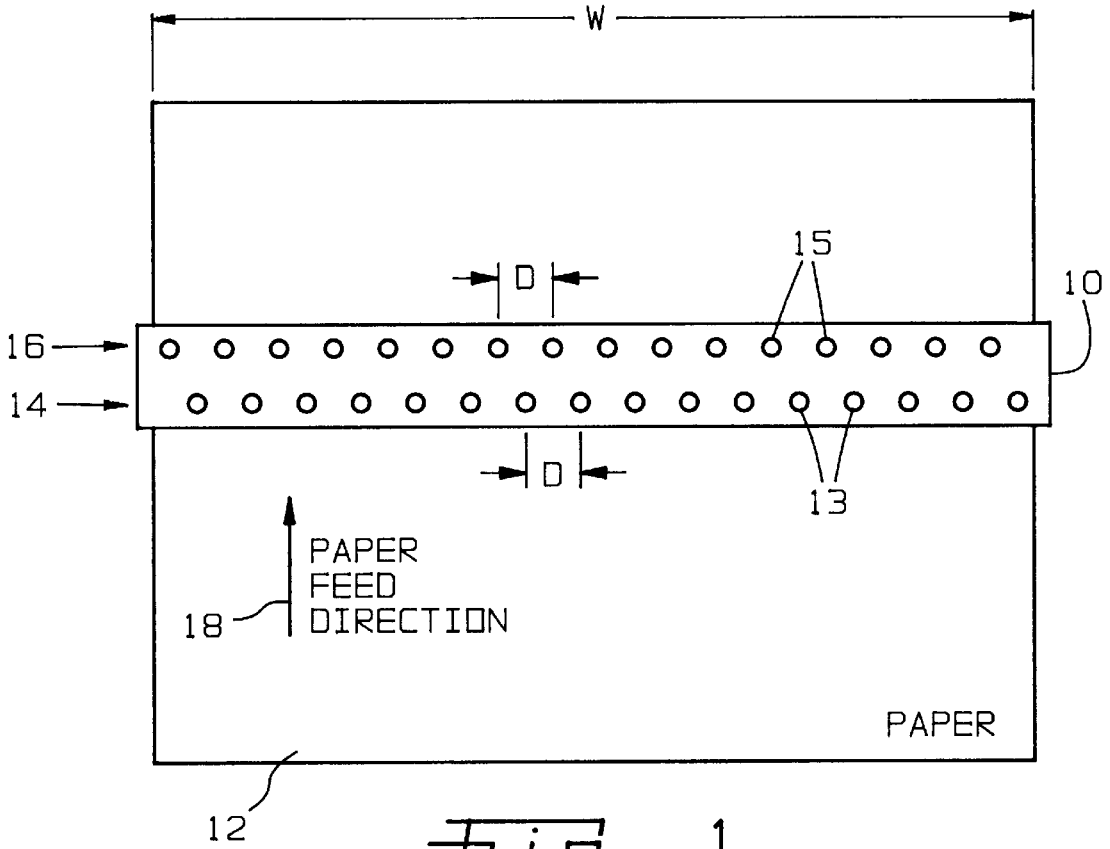
FIG. 1 is a schematic view of an embodiment of a page-width printhead of the present invention for use in an ink jet printer, with which the method of the present invention may be carried out.
Figure 2:
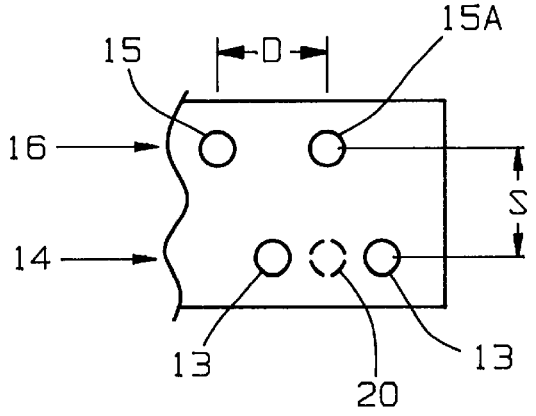
FIG. 2 is an enlarged, fragmentary view of a portion of the printhead shown in FIG. 1.

Referring now to the drawings and more particularly to FIGS. 1 and 2, there is shown an embodiment of a page width printhead 10 of the present invention for use in an ink jet printer for jetting an ink (not shown) onto a print medium such as paper 12. Printhead 10 may be used to carry out the method of printing of the present invention, as will be described hereinafter.

Printhead 10 includes at least two rows of ink emitting orifices 14 and 16 which extend substantially across a width "W" of paper 12. Row 14 includes a plurality of individual ink emitting orifices 13 and row 16 includes a plurality of individual ink emitting orifices 15. Each orifice 13 and 15 within rows 14 and 16, respectively, is spaced at a common distance "D" from an adjacent orifice within the same row of orifices 14 or 16. In the embodiment of printhead 10 shown in FIGS. 1 and 2, orifices 13 within row 14 are staggered a distance of approximately ½ the common distance "D" relative to orifices 15 within row 16 in a direction transverse to a feed direction 18 of paper 12.

The print medium such as paper 12 is moved in a feed direction 18 relative to the page wide printhead 10 extending thereacross. During printing, paper 12 is moved in feed direction 18 at a particular advance speed or velocity "v". The advance speed "v" typically remains constant during a particular print job; however, it is possible that the advance speed may also vary during a particular print job. As paper 12 is moved in feed direction 18 past printhead 10, ink is selectively jetted from orifices 13 of row 14 and orifices 15 of row 16. The ink which is jetted from orifices 13 and 15 has a known approximate drying time after being jetted onto paper 12 from printhead 10. Of course, many types of inks are available for possible use with printhead 10. However, in the embodiment shown, only one particular ink having known physical characteristics and a known approximate drying time is used with printhead 10. The specifically chosen ink may vary dependent upon the particular application for which printhead 10 is to be used.

Referring now more specifically to FIG. 2, each row of orifices 14 and 16 are spaced apart from each other in the feed direction 18 a distance "S" which is dependent upon an advance speed of print medium 12 and an approximate drying time of the ink jetted from printhead 10. Spacing "S" is established between rows 14 and 16 such that ink is jetted from orifices 15 of rows 16 after the ink which is jetted from orifices 13 of row 14 onto paper 12 has substantially dried. This provides an improved print quality and inhibits the formation of print artifacts on paper 12.

More particularly, the ink which is jetted from selected ones of the orifices 13 from row 14 is allowed to substantially dry before the ink is jetted from selected ones of the orifices 15 from row 16. The particular ink which is jetted from printhead 10 is selected such that the drying time of the ink satisfies the mathematical relationship:

$$S/v \geqq t$$

where

S=spacing in the feed direction between the two rows of orifices 14 and 16 (in.);

v=advance speed of the paper in the feed direction (in./sec.); and t=drying time of the jetted ink (sec.);

which may be mathematically manipulated such that the spacing "S" is determined from the formula:

$$S/v \geqq t*v.$$

It is thus possible, using the known advance speed of paper 12 and the drying time of the ink, to manufacture printhead 10 with a spacing "S" between the rows of orifices 14 and 16 which provides an improved print quality and inhibits the formation of print artifacts in the print image on paper 12.

During printing on paper 12 using printhead 10, paper 12 is advanced in feed direction 18 at a known advance speed. Ink is jetted from selected orifices 13 within row 14 onto paper 12 as paper 12 is advanced in feed direction 18. Thereafter, ink is jetted from selected orifices 15 within row 16 onto paper 12 after the ink jetted from orifices 13 has substantially dried.

For comparison purposes, an orifice 15A within row 16 is shown in relation to two orifices 13 within row 14 in FIG. 2. Orifice 15A would conventionally be placed at location 20 between the two orifices 13. If the orifice 15A was placed at location 20 in a conventional manner, it would thus be necessary to jet ink from orifice 15A at location 20 for a desired pixel associated with paper 12 as paper 12 travels past row 14. As described above, however, this may result in a poor print quality and formation of a print artifact on paper 12. By moving orifice 15A in printhead 10 a distance corresponding to spacing "S" in the feed direction, as shown, a time delay is created between adjacent ink dots which results in an improved print quality.

Figure 3:
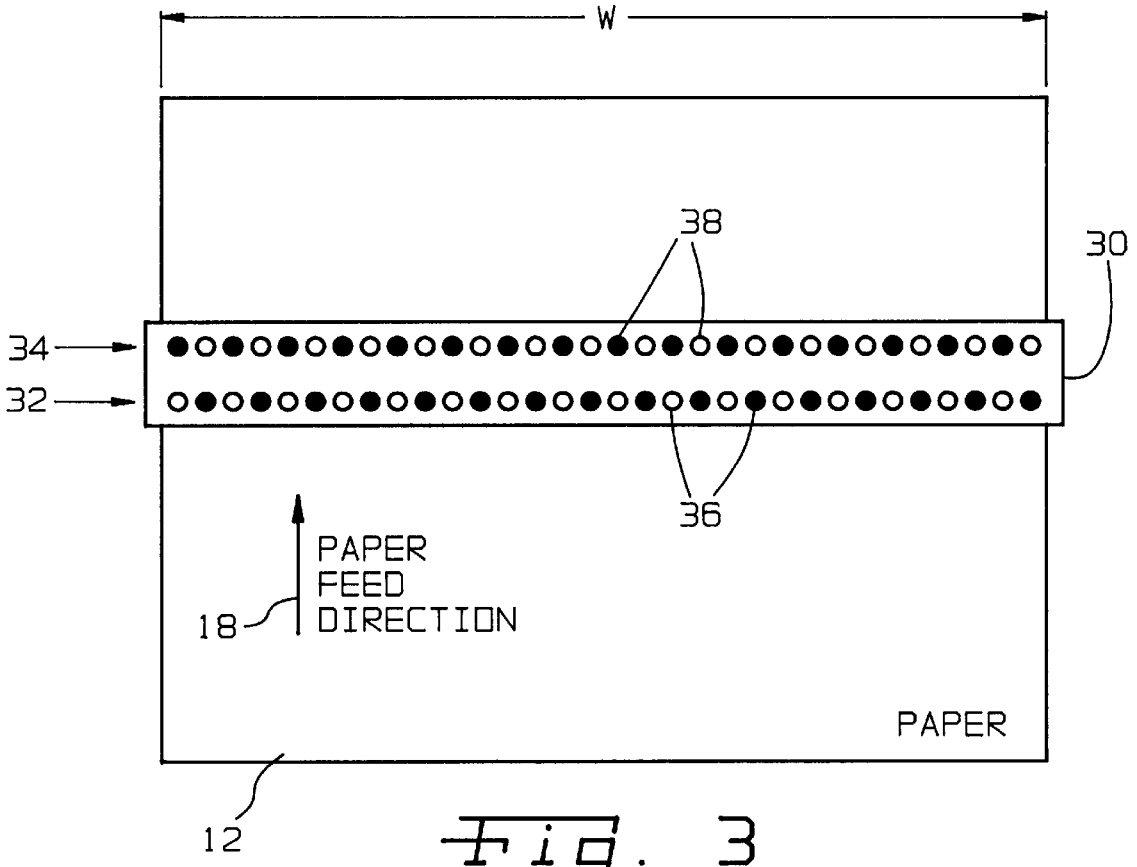
FIG. 3 is a schematic view of another embodiment of a page width printhead of the present invention for use in an ink jet printer, with which the method of the present invention may be carried out.

FIG. 3 is a schematic view of another embodiment of a page width printhead 30 of the present invention for use in an ink jet printer, with which the method of printing described above may be carried out. Printhead 30 includes two rows of orifices 32 and 34, with individual orifices being respectively referenced 36 and 38 in FIG. 3. Row 32 includes twice as many orifices as the row of orifices 14 of printhead 10 shown in FIGS. 1 and 2. Likewise, row 34 includes twice as many orifices 38 as the row of orifices 16 of printhead 10.

In contrast with the embodiment of printhead 10 shown in FIGS. 1 and 2, the row of orifices 34 of printhead 30 are substantially aligned relative to the row of orifices 32 in a direction transverse to feed direction 18 (that is, a line drawn parallel to feed direction 18 through the center of an orifice 36 in row 32 also extends through an approximate center of an orifice 38 in row 34). Within the row of orifices 32, only alternating orifices 36 are actually used during printing. For example, in the embodiment shown, the alternating orifices 36 used during printing have been filled-in or blackened. Likewise, within row of orifices 34, only alternating orifices 38 are used during printing, again represented by filled-in or blackened orifices 38. It is apparent from FIG. 3 that ink which is jetted from the filled in orifices 38 in row of orifices 34 are offset or staggered relative to the filled in orifices 36 which are used in the row of orifices 32. Thus, it will be noted that the orifices 36 and 38 which are actually used within printhead 30 are disposed in a staggered relationship relative to each other similar to the embodiment of printhead 10 shown in FIGS. 1 and 2.

The non-used orifices 36 within the row of orifices 32 and the non-used orifices 38 within the row of orifices 34 function as redundant orifices in the embodiment shown allowing continued use of printhead 30 in the event a particular orifice 36 or 38 fails. Such a failure might be the result of a blockage of an orifice 36 or 38, or a failure of a heater element associated with a particular orifice 36 or 38. In the event of a failure of an orifice 36 or 38, an adjacent orifice in an adjacent row of orifices may be used to allow continued use of printhead 30.

In the embodiments of the present invention shown in the drawings, the print medium is in the form of paper 12. However, it is also to be understood that other types of print media such as transparencies, etc. may be utilized with the method of the present invention.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of jetting an ink onto a print medium using an ink jet printer, said method comprising the steps of:

determining a substantially constant advance speed of the print medium during printing in a feed direction in the ink jet printer;

determining an approximate drying time of the ink after being jetted onto the print medium from said printhead; and forming at least two rows of ink emitting orifices in a printhead, said printhead and said at least two rows of orifices extending substantially across a width of the print medium, each said row of orifices being spaced apart from an adjacent said row of orifices in the feed direction a distance which is dependent upon said substantially constant advance speed of the print medium and said drying time of the ink.

2. The method of jetting an ink onto a print medium of claim 1, wherein said forming step comprises the further steps of:

spacing each said orifice within each said row at a common distance from an adjacent said orifice within each said row; and staggering said orifices within each said row relative to said orifices within an adjacent said row in a direction transverse to said feed direction.

3. The method of jetting an ink onto a print medium of claim 2, wherein said staggering step comprises staggering said orifices within each said row a distance of approximately one-half said common distance relative to said orifices within said adjacent row.

4. The method of jetting an ink onto a print medium of claim 1, wherein said forming step comprises the further step of spacing each said orifice within each said row at a common distance from an adjacent said orifice within each said row, said orifices within each said row being substantially aligned relative to said orifices within an adjacent said row in a direction transverse to said feed direction.

5. A method of letting an ink onto a print medium using an ink jet printer, said method comprising the steps of:

determining an advance speed of the print medium in a feed direction in the ink jet printer;

determining an approximate drying time of the ink after being jetted onto the print medium from said printhead; and forming at least two rows of ink emitting orifices in a printhead, said printhead and said at least two rows of orifices extending substantially across a width of the print medium, each said row of orifices in said printhead being spaced apart from said adjacent said row of orifices in the feed direction a distance (S) which is calculated from the mathematical formula:

$$S \geqq t*v$$

where

S=spacing in the feed direction between said adjacent said rows of orifices;

v=advance speed of the print medium in the feed direction; and t=drying time of the jetted ink.

6. A method of printing on a print medium using an ink jet printer, said method comprising the steps of:

providing a printhead including at least two rows of ink emitting orifices, each of said at least two rows of orifices extending substantially across a width of the print medium, and each said row of orifices being spaced apart from an adjacent said row of orifices in a feed direction of the print medium;

advancing the print medium in the feed direction at a known, substantially constant advance speed;

jetting an ink from one of said rows of orifices onto the print medium during said advancing step; and jetting the ink from said adjacent said row of orifices onto the print medium during said advancing step and after the ink jetted during said step of jetting an ink from one of said rows of orifices has substantially dried.

7. The method of printing of claim 6, wherein said steps of jetting an ink from one of said rows of orifices and jetting the ink from said adjacent said row of orifices comprise selectively jetting the ink from alternating said orifices in said one row and said adjacent row, said alternating orifices in said one row of orifices being staggered relative to said alternating orifices in said adjacent row of orifices.

8. The method of printing of claim 6, wherein said step of jetting the ink from said adjacent said row of orifices is carried out after said step of jetting an ink from one of said rows of orifices based upon a separation in time which is dependent upon said advance speed of the print medium and a spacing between said one row of orifices and said adjacent row of orifices in the feed direction.

* * * * *